US007963341B2

(12) United States Patent
Rios, III et al.

(10) Patent No.: US 7,963,341 B2
(45) Date of Patent: Jun. 21, 2011

(54) APPARATUS AND METHODS OF USE FOR A WHIPSTOCK ANCHOR

(75) Inventors: Aristeo Rios, III, Houston, TX (US); Greg Marshall, Magnolia, TX (US); Stephen Hermes Hester, Houston, TX (US); Adrian Vuyk, Jr., Houston, TX (US); Ken W. Winterrowd, Pearland, TX (US); Dan Blankenship, Shoreacres, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 89 days.

(21) Appl. No.: 11/368,210

(22) Filed: Mar. 3, 2006

(65) Prior Publication Data

US 2006/0207771 A1 Sep. 21, 2006

Related U.S. Application Data

(60) Provisional application No. 60/658,506, filed on Mar. 4, 2005.

(51) Int. Cl.
*E21B 23/01* (2006.01)

(52) U.S. Cl. ..... 166/382; 166/117.6; 166/215

(58) Field of Classification Search ..... 166/118, 166/120, 136, 137, 138, 382, 117.6, 215
See application file for complete search history.

(56) References Cited

U.S. PATENT DOCUMENTS

| | | | | | |
|---|---|---|---|---|---|
| 903,314 | A | * | 11/1908 | Porter | 166/123 |
| 1,536,370 | A | * | 5/1925 | Becker | 166/137 |
| 2,121,050 | A | * | 6/1938 | Ragan et al. | 166/120 |
| 2,207,920 | A | * | 7/1940 | Hughes | 175/81 |
| 2,766,010 | A | * | 10/1956 | Hester | 166/117.6 |
| 4,043,390 | A | * | 8/1977 | Glotin | 166/215 |
| 5,348,090 | A | | 9/1994 | Leismer | |
| 5,488,989 | A | * | 2/1996 | Leising et al. | 166/255.3 |
| 5,743,331 | A | | 4/1998 | Adkins et al. | |
| 5,829,531 | A | * | 11/1998 | Hebert et al. | 166/382 |
| 5,878,818 | A | | 3/1999 | Hebert et al. | |
| 6,360,821 | B1 | | 3/2002 | Braddick | |
| 6,702,014 | B1 | * | 3/2004 | McGarian et al. | 166/117.6 |
| 6,935,423 | B2 | | 8/2005 | Kusmer | |

FOREIGN PATENT DOCUMENTS

| | | |
|---|---|---|
| CA | 2 522 910 | 3/2001 |
| SU | 981 556 | 12/1982 |

OTHER PUBLICATIONS

GB Search Report, Application No. 0604489.5, dated Jul. 5, 2006.
GB Examination Report for Application No. GB0604489.5 dated Feb. 17, 2010.
GB Examination Report for Application No. GB0604489.5 dated Aug. 18, 2009.

* cited by examiner

*Primary Examiner* — David J Bagnell
*Assistant Examiner* — David Andrews
(74) *Attorney, Agent, or Firm* — Patterson & Sheridan, LLP

(57) ABSTRACT

An anchor for a wellbore is adaptable to be operated in at least two separate and distinct ways. In one embodiment, a whipstock anchor is provided that can be operated either mechanically or hydraulically. In another embodiment, the anchor is designed to run through a restriction in a retracted position and thereafter expanded to position a wellbore tool in the wellbore. Preferably, the anchor is expandable to set in wellbores of various sizes and either cased or uncased.

34 Claims, 6 Drawing Sheets

APPARATUS AND METHODS OF USE FOR A WHIPSTOCK ANCHOR

CROSS-REFERENCE TO RELATED APPLICATIONS

This application claims benefit of co-pending U.S. Provisional Patent Application Ser. No. 60/658,506, filed on Mar. 4, 2005, which application is incorporated herein by reference in its entirety.

BACKGROUND OF THE INVENTION

1. Field of the Invention

The present invention relates to a downhole tool. More particularly, the invention relates to a downhole tool that can be actuated in multiple, separate ways. More particularly still, the invention relates to a downhole anchor that can be set either mechanically or hydraulically in casing of a variety of sizes and weights.

2. Description of the Related Art

When oil and gas wells are drilled, a bore hole is formed in the earth and typically lined with steel pipe that is cemented into place to prevent cave in and to facilitate the isolation of certain areas of the wellbore for the collection of hydrocarbons. Once the steel pipe or casing is cemented into place, the hydrocarbons are typically gathered using a smaller string of tubulars, called production tubing. Due to a variety of issues, including depletion of formations adjacent the wellbore and stuck tools and pipe that prevent continued use of the wellbore, it is often desirable to form another wellbore, not from the surface but from some location along the existing wellbore. This new, or lateral wellbore can be lined with pipe and hydrocarbons can then be collected along its length. It is not uncommon to have more than one lateral, or sidetracked wellbore extending from a single central or parent wellbore.

Initiating a new wellbore from a cased, central wellbore requires a hole or window be formed in the casing wall adjacent that location where the new wellbore will commence. Forming windows is typically done with the help of a whipstock which is a wedge-shaped member having a concave face that can "steer" a mill or cutter to a side of the casing where the window will be formed. Whipstocks and their use are well known and an example is shown in U.S. Pat. No. 6,464,002 owned by the same assignee as the present invention and that patent is incorporated by reference herein in its entirety. The whipstock may be run in by itself or to save a trip, the whipstock might be run in with the mill or cutter temporarily attached to its upper edge. In any case, the whipstock has to be anchored in the wellbore at its lower end to keep it in place and to resist the downward force placed upon it as the cutter moves along its length through the casing wall.

Various anchors are used with whipstocks and prior art anchors can be mechanically set or hydraulically set. Mechanical anchors include those that require a compressive force to shear a pin and permit the anchor to assume a second, set position. Mechanical anchors work well when the anchor is to be set at the bottom of a wellbore or when there is some type of restriction that has been placed in the wellbore, like a bridge plug. In those instances, there is a stationary surface available to use to generate the compressive force needed to set the mechanical anchor. In other instances, the anchor must be set at some point along the wellbore where there is no surface to act upon in order to create a compressive force. In these instances, the anchors can be set with pressurized fluid, but that requires a different apparatus and the type of anchor actually needed on a job is not always apparent in advance.

Because of the uncertainty of equipment needed to best form a window in a casing, there are instances in which the wrong type anchor is on site and delays are created as another more appropriate anchor is found. An additional problem relates to the fact that most prior art anchors offer little flexibility in the size casing in which they can operate. For example, prior art anchors with slip and cone arrangements are designed to increase their outer diameters minimally when they are set and only work properly when they are designed for the specific inner diameter casing in which they are used. Additionally, it is not uncommon to encounter a restriction in the form of garbage as even casing of a smaller inside diameter prior to reaching larger diameter casing where the anchor is to be set. Many prior art anchors that are small enough to fit through the restriction will not expand far enough to become properly set in the larger casing.

There is a need for an anchor that is adaptable to be operated either mechanically or hydraulically. There is a further need for an anchor that can be operated in casings of varying diameters.

SUMMARY OF THE INVENTION

Embodiments of the present invention provide an anchor for a wellbore that is adaptable to be operated in at least two separate and distinct ways. In one embodiment, a whipstock anchor is provided that can be operated either mechanically or hydraulically. In another embodiment, the anchor is designed to be set in casing of various inner diameters, even after the unset anchor is run through restrictions. In a further embodiment, there is a method of forming a window in a casing well using the whipstock anchor of the present invention.

In another embodiment, an anchor for supporting a downhole tool in a wellbore comprises a first body and second body, the bodies slidably movable relative to each other to increase an outer diameter of the anchor in a set position; a biasing member disposed between the first body and the second body, the biasing member arranged to move the anchor from a run in position to the set position; and a triggering mechanism for initiating the movement of at least one of the bodies to the set position. In another embodiment, the triggering mechanism is readily adaptable to be operated either mechanically or hydraulically.

In yet another embodiment, a method of supporting a downhole tool in a wellbore comprises providing the downhole tool with an anchor, the anchor having a first body and second body, the bodies slidably movable relative to each other to increase an outer diameter of the anchor in a set position; a biasing member disposed between the first body and the second body, the biasing member arranged to move the anchor from a run in position to the set position; and a triggering mechanism for initiating the movement of at least one of the bodies to the set position. The method further comprises running the downhole tool and the anchor into the wellbore on a tubular string; activating the anchor, thereby causing the biasing member to move the second body relative to the first body; and setting the anchor in the wellbore. In another embodiment, the method includes supplying a compressive mechanical force to sufficient to cause a shearable connection to fail. Alternatively, a hydraulic force is applied to set the anchor.

In another embodiment, the anchor is hydraulically activated and mechanically set.

Embodiments of the anchor are suitable for use with any downhole tool requiring support in a wellbore, including, but not limited to, whipstock, packer, plugs, and a wellbore tubular

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
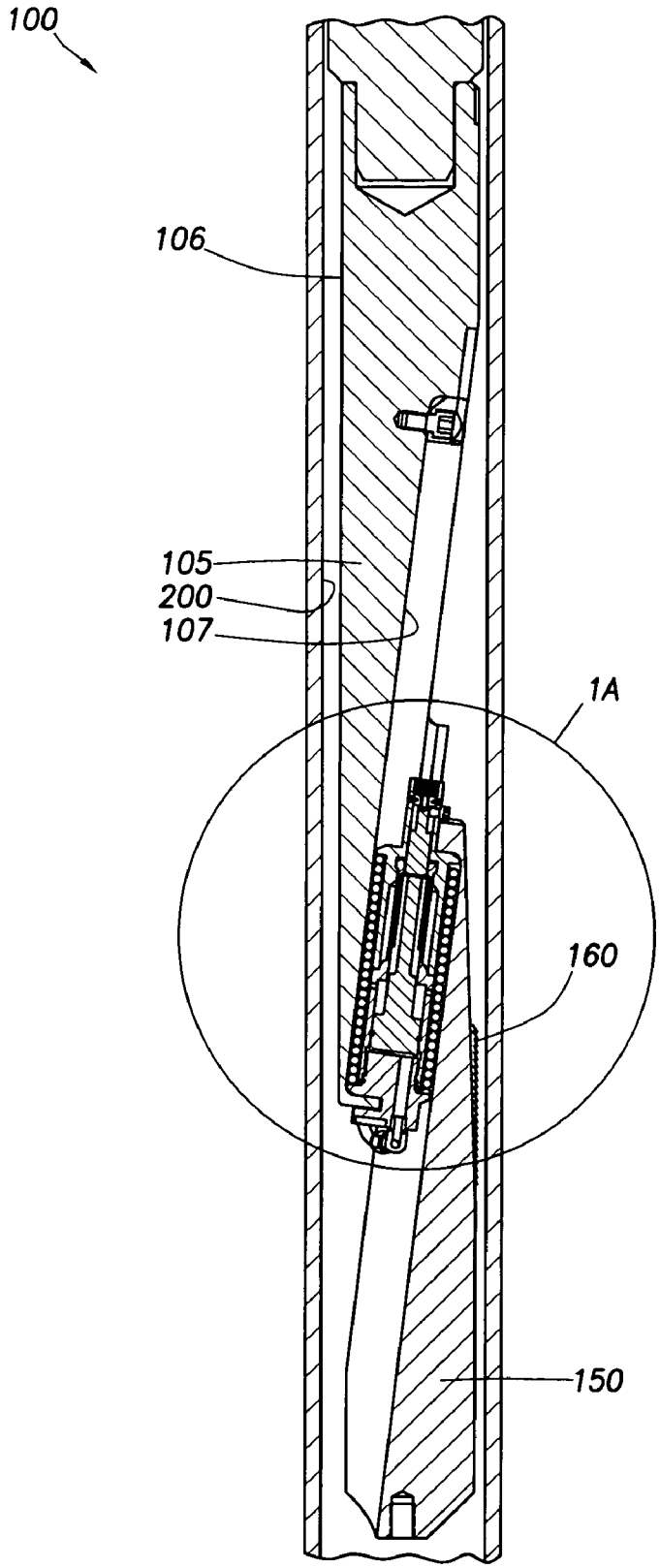
FIG. 1 is a side, section view of a hydraulic version of the anchor of the present invention, shown in a run-in position.

FIG. 1 is a side, section view of a hydraulic version of an anchor of the present invention, shown in a run-in position. The anchor 100 includes an anchor body 105 which is essentially a wedge-shaped, semicircular member with a first surface 106 substantially parallel to the inner wall 200 of surrounding casing and an inner surface 107 having sides that are gradually sloped. The anchor body 105 is connected to a whipstock which is not shown but is typically located directly above the anchor 100. A slip body 150 is somewhat of a mirror image of the anchor body 105 with inner and outer surfaces that are opposed to the surfaces of the anchor body 105. The slip body 150 typically includes at least one slip member 160 and is substantially free-floating relative to the anchor body 105.

Figure 1A:
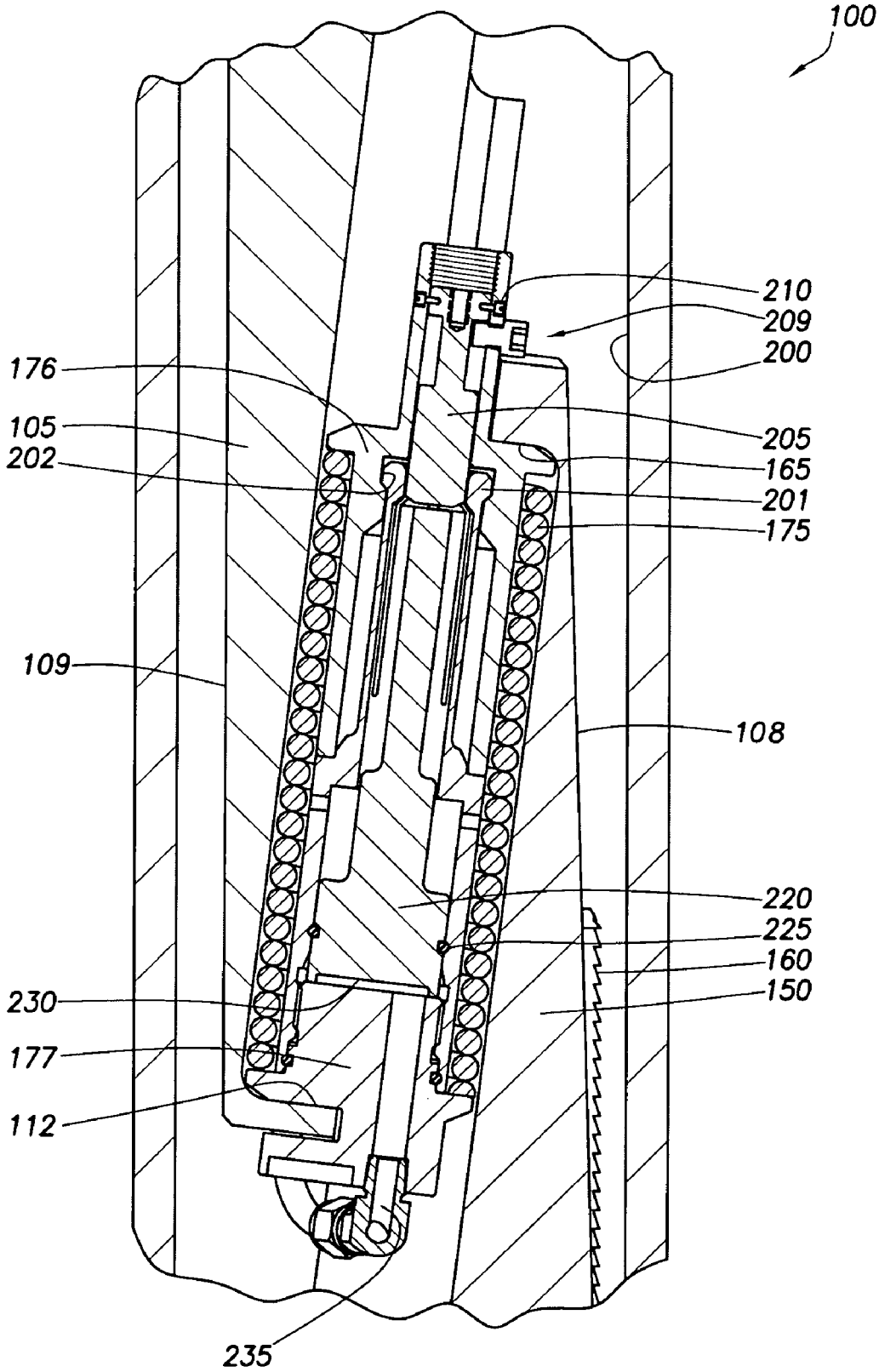
FIG. 1A is an enlarged view of the anchor of FIG. 1.

FIG. 1A is an enlarged view of the anchor 100 of FIG. 1. Due to a shoulder 165 formed at its upper end, the slip body 150 is movable relative to the anchor body 105 by a biasing member such as a compression spring 175. Spring 175 is disposed between the anchor body 105 and the slip body 150 and is retained by retention members 176,177 at each end. The spring 175 acts to move the two bodies 105,150 relative to each other in order to set the anchor 100, as will be shown and discussed herein. A shoulder 112 formed at a lower end of the anchor body 105 permits the anchor body 105 to be moved relative to the slip body 150 due to movement of the spring 175.

Figure 2:
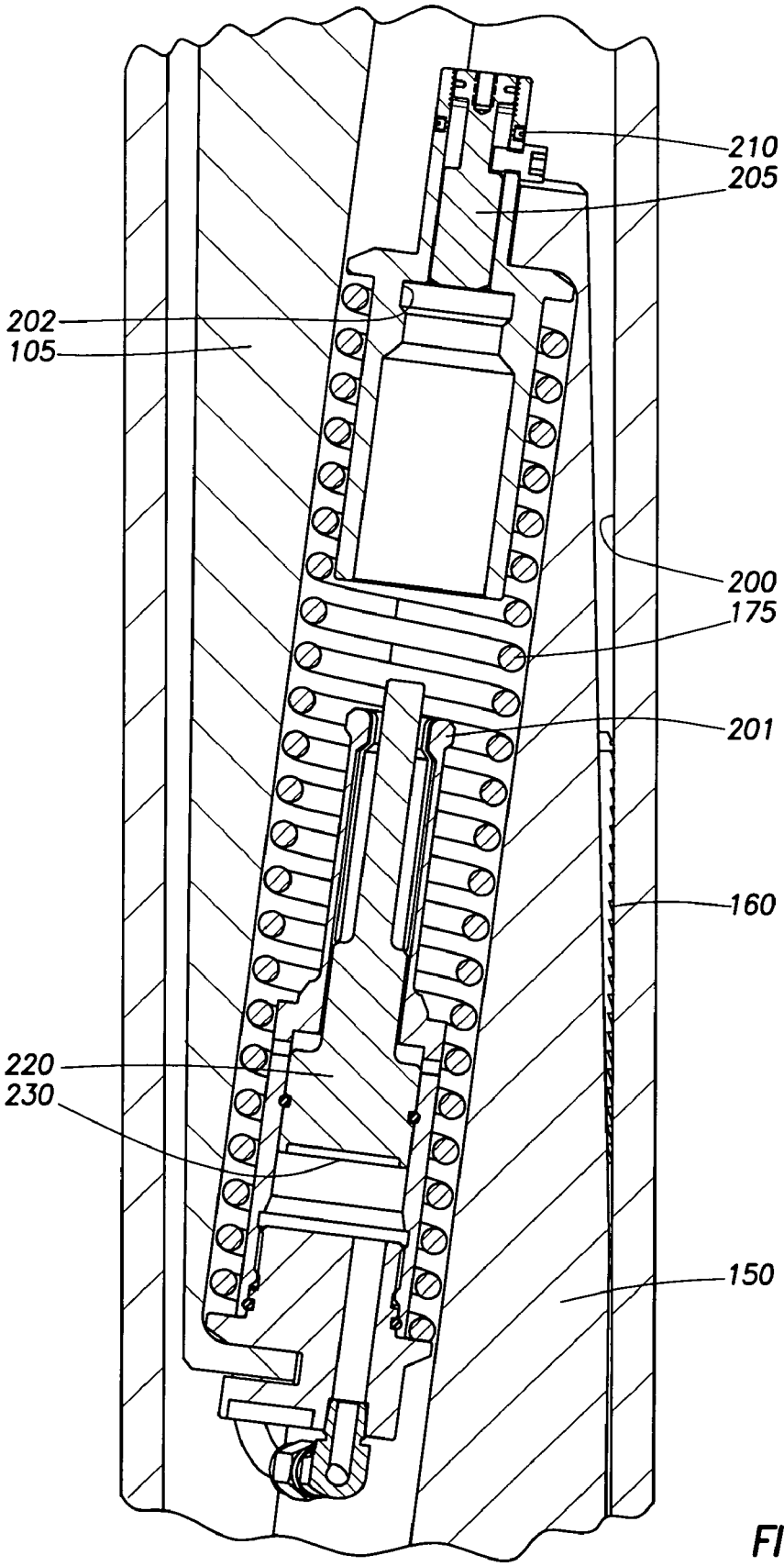
FIG. 2 is a side, section view of the anchor of FIG. 1, shown in a set position.

As stated, the anchor 100 shown in FIGS. 1-2 is operable hydraulically. Disposed between the anchor body 105 and the slip body 150 is a trigger assembly generally noted as 209. The assembly 209 includes not only the compression spring 175 but also a locking mechanism to retain the spring 175 in its compressed, run-in position shown in FIGS. 1 and 1A. As shown, the locking mechanism is hydraulically activated to release the spring 175. The spring 175 remains compressed due to a set of collet fingers 201 which are housed within a groove 202 formed in retention member 176. The fingers 201 are prevented from leaving the groove 202 by a shear piston 205 which supports the inner surface of the collet fingers 201 as shown in FIG. 1A. The shear piston 205 is retained in its position relative to the collet fingers 201 by a frangible member such as shear pins 210 at its upper end that temporarily tie it to retention member 176. In this respect, the trigger assembly 209 is only activated when a hydraulic force is applied and cannot be activated by a mechanical force. Advantageously, the anchor 100 cannot accidentally activate when it encounters an obstruction or is inadvertently dropped in the wellbore. In one embodiment, one or more shear pins 210 are circumferentially disposed. In another embodiment, one or more shear pins 210 are disposed axially relative to the each other.

At a lower end of the shear piston 205 is a seal piston 220 having a seal member 225 and a piston surface 230 at a lower end thereof. The piston surface 230 is in fluid communication with a fluid line 235 which is visible in FIG. 1A and typically runs upwards past the whipstock (not shown) to a tubular string that carries the whipstock and the anchor 100 into the wellbore. Operating a downhole tool with pressurized fluid through a fluid line that bypasses a whipstock is well known in the art and an example of such an arrangement is shown in U.S. Pat. No. 6,364,037 assigned to the same owner as the present application and that patent is incorporated by reference herein in its entirety. Alternatively, pressurized fluid may be supplied to the anchor in any suitable manner known to a person of ordinary skill in the art.

FIG. 2 is a side, section view of the anchor 100 of FIG. 1, shown in a set position. In this Figure, the compression spring 175 has been permitted to relax and in doing so has pulled the anchor body 105 and the slip body 150 towards each other along their sloped, inner surfaces. The result is an enlarged effective "outer diameter" that puts the slip member 160 in contact with the casing wall 200, thereby fixing the anchor 100 in the wellbore. The design of the anchor 100 includes two important features. First, the anchor 100 will set at virtually any point along the length of its "throw" or at any point between its run-in position and that point where the compression spring 175 is essentially completely relaxed and the bodies 105, 150 can move no further along their respective surfaces. Secondly, (as is visible in FIG. 4) the slip body 150 is formed with one or more tapered surfaces 308, 309, 310 (also referred to herein as "undercut") at an end thereof. In one embodiment, the taper surfaces 308, 309, 310 begin at the slip member 160 and tapers inward. The surfaces are tapered to ensure the slip 160 contacts the casing wall 200 instead of the slip body 150 regardless of the relative positions of the anchor body 105 and slip body 150. In FIG. 1A, the slip body 150 is also provided with a tapered surface 108. In another embodiment, the lower portion of the anchor body 105 also includes one or more sloped surfaces 109. With the design disclosed herein, the anchor 100 can effectively operate with an increased diameter of as much as 30%.

In operation, the anchor 100 is used as follows. When the anchor 100 is at the location in the wellbore where it is to be set, pressurized fluid is introduced into fluid line 235 and onto the piston surface 230 of seal piston 220. The pressurized fluid forces the piston 220 upwards and into contact with shear piston 205. In turn, the shear force is exerted to the shear pins 210. At a predetermined force, shear piston 205 causes the shear pins 210 to fail and the shear piston 205 moves out of contact with the collet fingers 201, thereby permitting relative movement between the collet fingers 201 and retention member 176. The retention member 176 is urged away from retention member 177 by the spring 175. Initially, a sloped side surface of groove 202 causes the collet fingers to bend inward and move out of the groove 202 as the spring 175 moves the retention member 176 away. Thereafter, the expansion force of the spring 175 moves the slip body 150, which is in contact with the retention member 176, up the inner surface 107 of the anchor body 105, thereby moving the slip body 150 outward into contact with the casing wall. During relative movement between the bodies 105, 150, the undercut of the anchor body 105 prohibits the anchor body 105 from interfering with the slip body 150 pushing the slip member 160 outward. Also, the undercut of the slip body 150 becomes generally parallel with the casing wall 200, which exposes more of the slip members 160 into contact with the casing wall 200. The foregoing action increases the outer diameter of the anchor 100 until slip member 160 is in contact with casing wall 200. Preferably, only the slip members 160 of the slip body 150 are in contact with casing wall 200. In the preferred embodiment, a set down force is applied from the surface to the anchor 100 to fully set the anchor 100 in the casing.

Figure 2A:
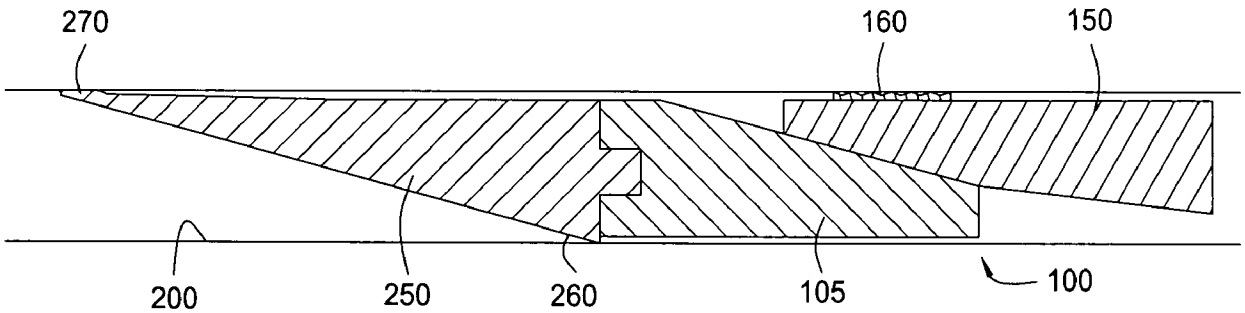
FIG. 2A is a schematic view of the anchor and a whipstock shown in a set position.

After activation, the anchor 100 provides a stable, three point contact 160, 260, 270 with the casing wall 200 to support the whipstock 250, as illustrated in FIG. 2A. During activation, as the slip body 150 moves outward, the anchor 100 forces the whipstock 250 to pivot off its bottom end 260 and the whipstock tip 270 is forced into contact with the casing wall 200. Thus, a three point contact is created between the slips 260, pivot point 260, and the whipstock tip 270. This three point contact is particularly advantageous for performing low-side exit, i.e., a low side lateral. As shown in FIG. 2A, due to the pivot action, the weight of the whipstock 250 is directed upwards. When the drill bit or mill is directed toward the casing wall 200 by the whipstock 250, the weight of the whipstock 250 acting on the bit is significantly reduced, thereby facilitating the exit process.

Figure 3:
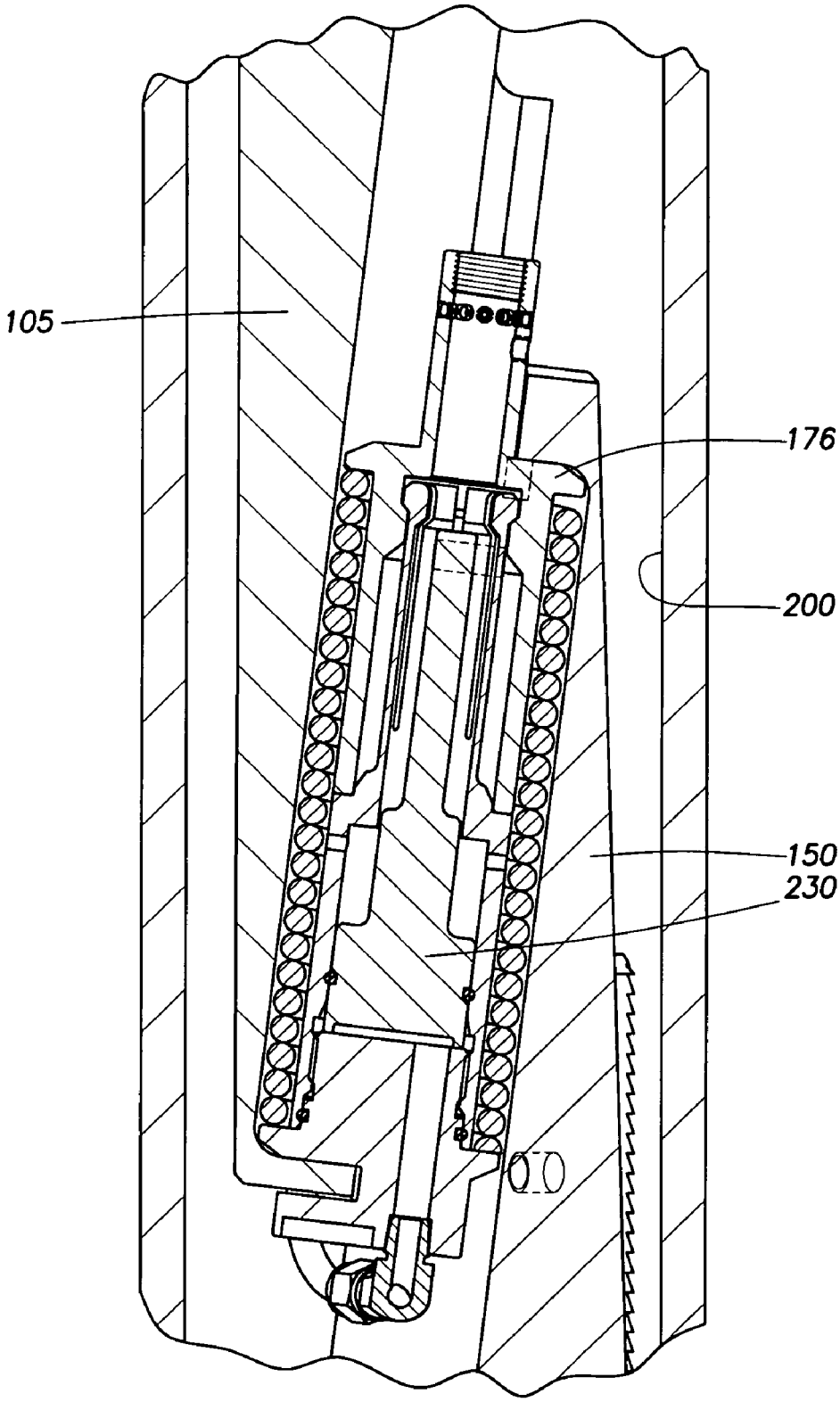
FIG. 3 is a section view of a mechanical version of the anchor.

FIG. 3 is a section view of the anchor 100 having a mechanical triggering mechanism. The availability of different triggering or actuation mechanism options while using identical or almost identical parts provides flexibility in choosing the proper actuation technique on site, if necessary. Also, the anchor 100 can be modified with very little effort and very few, if any, additional parts. In this manner, the anchor 100 is readily adaptable to operate either hydraulically or mechanically. In the mechanically operated embodiment, the shear piston 205 is removed along with the shear pins 210 that initially connects the shear pistons 205 to retention member 176. While the seal piston 230 remains, it has no function when the anchor 100 is triggered mechanically. In place of the shear piston and pins, external shear pins are used that hold the anchor 100 in a set position until it is actuated downhole. While the anchor 100 can be used mechanically or hydraulically with the changes described herein, it will be understood that the anchor 100 could become effectively mechanical or hydraulic using a variety of modifications known to a person of ordinary skill in the art, and those modifications are all within the scope of this invention.

Figure 4:
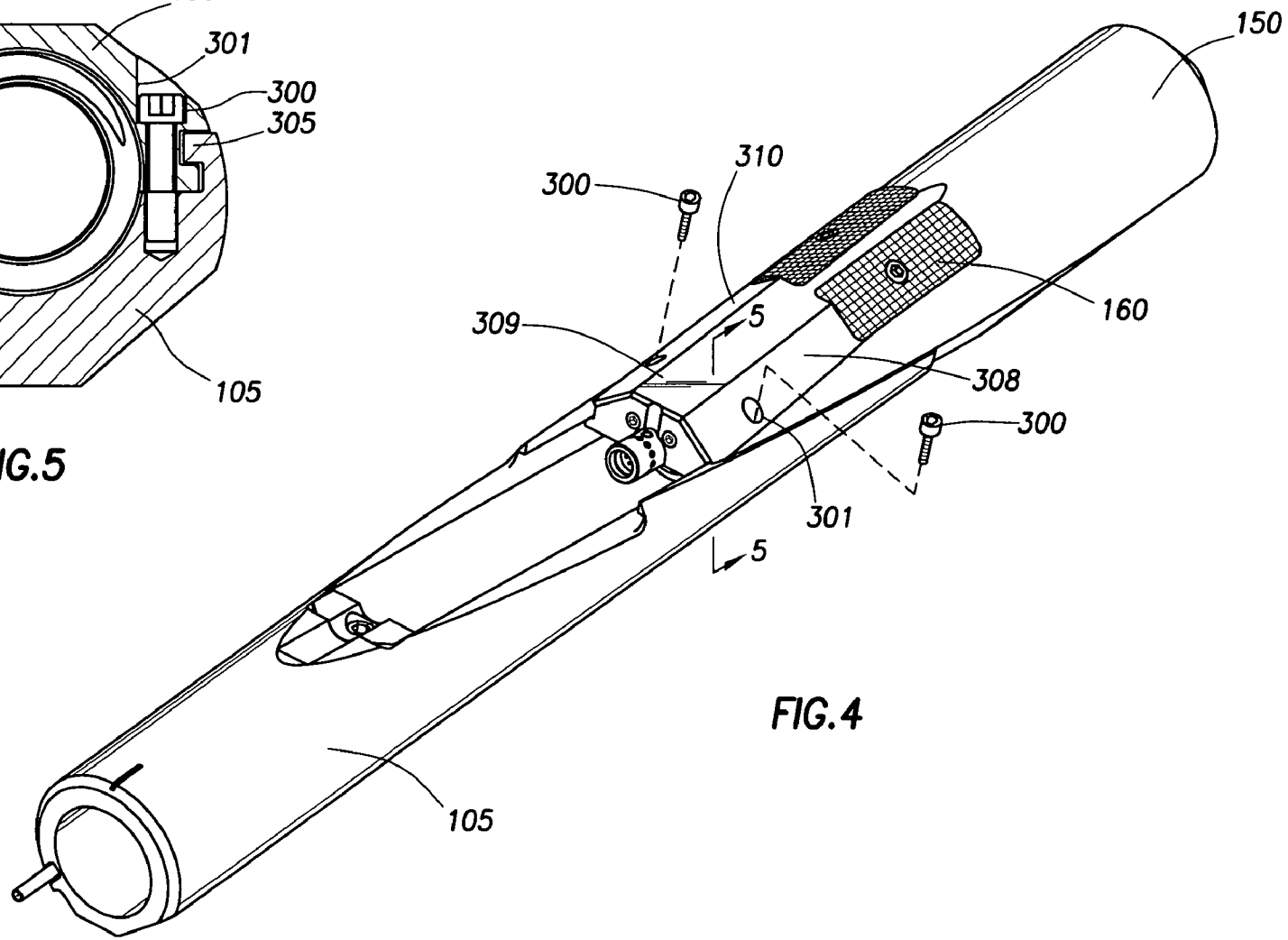
FIG. 4 is an isometric view of the anchor of FIG. 3.

FIG. 4 is an isometric view of the anchor arranged with a mechanical triggering mechanism and includes a temporary connection between the two bodies 105, 150 in the form of two external shear pins 300. Each external shear pin 300 extends through an aperture 301 formed in each body 105, 150 in an off-center fashion so that they do not penetrate the inner cavity of the anchor 100 where spring 175 is housed.

Figure 5:
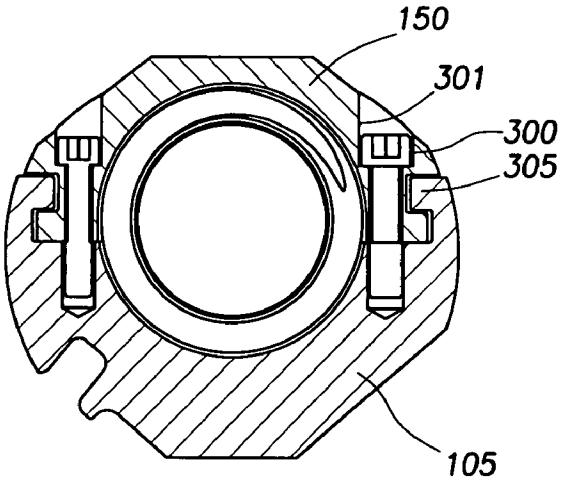
FIG. 5 is a section view of the anchor along a line 5-5 of FIG. 4.

FIG. 5 is a section view of the anchor of FIG. 4 along a line 5-5. Visible are the external shear pins 300 extending between the bodies 105, 150 and fixing them relative to each other. Also visible in the Figure is the tongue and groove arrangement 305 that permits the bodies 105, 150 to move past each other as the anchor 100 is set.

In practice, the anchor of FIGS. 3-5 are used as follows. The anchor 100 is transported into a wellbore at the end of a string of tubulars, usually with a mill temporarily attached between the string and an upper end of the whipstock. When the assembly reaches a predetermined depth, it is put into compression by contacting either a bottom of the hole or a bridge plug or some other restriction therebelow. At a predetermined compressive force, the shear pins 300 or other suitable trigger devices will fail and the device is triggered with the compression spring 175 operating to move the bodies 105, 150 relative to each other and to increase the outer diameter of the anchor 100 until the slips 160 contacts casing wall 200. Thereafter, weight can be set down from the surface to further fix the anchor in the wellbore prior to operating the mill and forming the casing window.

Figure 6:
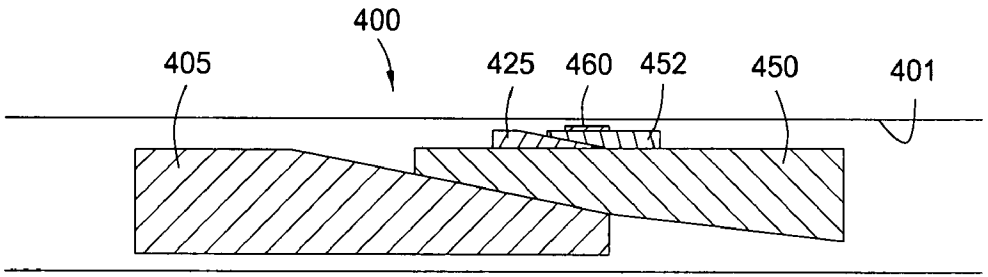
FIG. 6 is a schematic view of an embodiment of an anchor having dual slip bodies.

In another embodiment, the anchor may include dual slip bodies as illustrated in FIG. 6. The anchor 400 includes a first anchor body 405 and a first slip body 450. A second anchor body 425 and a second slip body 452 are disposed on the first slip body 450. Slip members 460 are provided on the second slip body 452 for engagement with the casing 401. In this respect, the effective outer diameter of the anchor 400 is further increased when the second slip body 452 is activated. In this manner, an even larger diameter tubular or wellbore may be engaged by the anchor.

Figure 7:
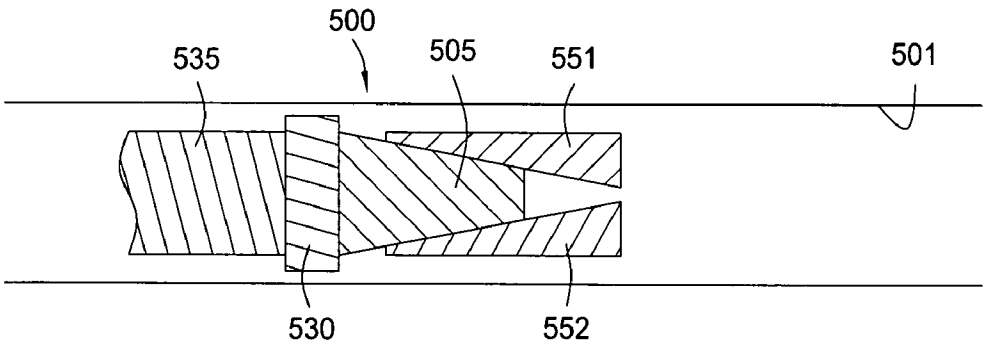
FIG. 7 is a schematic view of an embodiment of an anchor for setting a packer.

FIG. 7 shows an embodiment of the anchor 500 used to set a packer 530 in a casing 501. The packer 530 is run in on a tubular 535, and the anchor 500 is attached to a lower portion of the tubular 535. The packer 530 may comprise an elastomeric material such as rubber. The anchor 500 includes an anchor body 505 having at least two inclines for receiving complementary slip bodies 551, 552. As the slip bodies 551, 552 move up their respective inclines, the front portion of the slip bodies 551, 552 contact and deform the packer 530 into contact with the casing 501. In this manner, the anchor 500 may be used to simultaneously squeeze and set the packer 530. It must be noted that the packer may be set using any anchor described herein. In this respect, after the packer is set, set down weight may be applied to compress the packer into sealing engagement with the casing wall.

While the foregoing is directed to embodiments of the present invention, other and further embodiments of the invention may be devised without departing from the basic scope thereof, and the scope thereof is determined by the claims that follow.

We claim:

1. An anchor for supporting a downhole tool in a wellbore, comprising:

a first body having a first inclined surface;

a second body having a second inclined surface;

a cavity formed between the first and second inclined surfaces, wherein the bodies are slidably movable relative to each other along a portion of the first and second inclined surfaces to increase an outer diameter of the anchor in a set position;

a biasing member disposed in the cavity, wherein the biasing member is arranged to move the anchor from a run in position to the set position; and a triggering mechanism for initiating movement of at least one of the bodies to the set position, wherein the triggering mechanism includes a shearable connection and a releasable locking connection, wherein the biasing member is adapted to release the releasable locking connection.

2. The anchor of claim 1, wherein the shearable connection is readily adaptable to be operated either mechanically or hydraulically.

3. The anchor of claim 1, wherein the triggering mechanism is hydraulically actuated.

4. The anchor of claim 3, wherein the triggering mechanism includes at least one piston member housed in the cavity, the at least one piston member arranged to cause the shearable connection to fail upon application of fluid pressure to the piston member.

5. The anchor of claim 4, wherein the releasable locking connection includes collet fingers that retain the anchor in the run in position until the shearable connection fails.

6. The anchor of claim 1, wherein the triggering mechanism is mechanically actuated.

7. The anchor of claim 1, wherein the releasable locking connection couples the first body to the second body, and is arranged to be disabled upon a predetermined compressive force between the first body and the second body.

8. The anchor of claim 1, wherein the biasing member comprises a compression spring.

9. The anchor of claim 1, further comprising at least one slip member formed on at least one of the first body and the second body.

10. The anchor of claim 9, wherein in the set position, the at least one slip member is in contact with the wellbore.

11. The anchor of claim 1, wherein the first body is coupled to the downhole tool and a portion of the first inclined surface is in contact with a portion of the second inclined surface.

12. The anchor of claim 11, wherein the second body is moved relative to the first body to increase the outer diameter of the anchor.

13. The anchor of claim 1, wherein the second body includes an outer surface having at least one tapered portion.

14. The anchor of claim 13, wherein the at least one tapered outer surface is substantially parallel to a wall of the wellbore after the anchor is set.

15. The anchor of claim 13, further comprising at least one slip member disposed on the outer surface.

16. The anchor of claim 1, wherein the first body is coupled to the second body using a tongue and groove arrangement.

17. A method of supporting a downhole tool in a wellbore, comprising:

providing the downhole tool with an anchor, the anchor having:

a first body having a first inclined surface;

a second body having a second inclined surface;

a cavity formed between the first and second inclined surfaces, wherein the bodies are slidably movable relative to each other along a portion of the first and second inclined surfaces to increase an outer diameter of the anchor in a set position;

a biasing member disposed in the cavity, wherein the biasing member is arranged to move the anchor from a run in position to the set position; and a triggering mechanism for initiating movement of at least one of the bodies to the set position;

running the downhole tool and the anchor into the wellbore on a tubular string;

activating the anchor by applying a hydraulic force and a mechanical force to the triggering mechanism, wherein applying the hydraulic force causes a shearable connection to fail and applying the mechanical force causes a releasable locking connection to fail, and wherein the mechanical force is applied by the biasing member, thereby causing the biasing member to move the second body relative to the first body; and setting the anchor in the wellbore.

18. The method of claim 17, wherein the hydraulic force is exerted against a piston surface of the triggering mechanism.

19. The method of claim 17, further comprising forming at least a three point contact with the wellbore when the anchor is set.

20. The method of claim 19, wherein the downhole tool comprises a whipstock, and the whipstock provides at least one of the at least three point contacts.

21. The method of claim 17, wherein the downhole tool comprises a whipstock.

22. The method of claim 21, wherein the downhole tool further comprises a cutting tool.

23. The method of claim 22, further comprising urging the cutting tool along the whipstock and forming a window in the wellbore while the whipstock is retained in the wellbore by the anchor.

24. The method of claim 17, wherein the anchor further comprises a second anchor disposed on at least one of the bodies.

25. The method of claim 17, wherein the downhole tool comprises a packer.

26. The method of claim 25, further comprising setting the packer.

27. The method of claim 26, wherein setting the packer comprises urging at least one of the bodies against the packer.

28. The method of claim 27, wherein the second body comprises one or more slip bodies, wherein each of the slip bodies include at least one slip member.

29. The method of claim 17, wherein the releasable locking connection comprises a collet finger.

30. A method of supporting a downhole tool in a wellbore, comprising:

providing the downhole tool with an anchor, the anchor having:

a first body and a second body that form a cavity between an inclined surface of each body, the bodies slidably movable relative to each other along a portion of the inclined surfaces to increase an outer diameter of the anchor in a set position;

a biasing member disposed in the cavity, the biasing member arranged to move the anchor from a run in position to the set position;

a releasable locking connection connecting the first body to the second body; and a shearable connection adapted to maintain the releasable locking connection, wherein the shearable connection comprises a retaining member to maintain the releasable locking connection;

running the downhole tool and the anchor into the wellbore on a tubular string;

breaking the shearable connection;

releasing the releasable locking connection; and expanding the biasing member to move the anchor to the set position.

31. The method of claim 30, wherein releasing the releasable locking connection comprises moving the retaining member.

32. An anchor for supporting a downhole tool in a wellbore, comprising:

a first body and a second body that form a cavity between an inclined surface of each body, the bodies slidably movable relative to each other along a portion of the inclined surfaces to increase an outer diameter of the anchor in a set position;

a biasing member disposed in the cavity, the biasing member arranged to move the anchor from a run in position to the set position; and a triggering mechanism for initiating the movement of at least one of the bodies to the set position, wherein the triggering mechanism includes a shearable connection and a releasable connection, wherein the releasable connection includes collet fingers that retain the anchor in the run in position until the shearable connection fails.

33. A method of supporting a downhole tool in a wellbore, comprising:

providing the downhole tool with an anchor, the anchor having:

a first body and a second body that form a cavity between an inclined surface of each body, the bodies slidably movable relative to each other along a portion of the inclined surfaces to increase an outer diameter of the anchor in a set position; and a biasing member disposed in the cavity, the biasing member arranged to move the anchor from a run in position to the set position;

running the downhole tool and the anchor into the wellbore on a tubular string;

activating the anchor by applying a hydraulic force and a mechanical force to the anchor, wherein the biasing member is adapted to release a releasable locking connection that is configured to retain the anchor in the run in position until a shearable connection fails, thereby causing the biasing member to move the second body relative to the first body; and setting the anchor in the wellbore.

34. The method of claim 33, wherein the mechanical force is applied by the biasing member.

* * * * *